US009365007B2

(12) United States Patent
Lose et al.

(10) Patent No.: US 9,365,007 B2
(45) Date of Patent: Jun. 14, 2016

(54) FOUR-BAR PRESS WITH INCREASED STROKE RATE AND REDUCED PRESS SIZE

(71) Applicant: Metal Systems Technologies, LLC, Media, PA (US)

(72) Inventors: John G. Lose, Media, PA (US); Sheldon A. Spachner, Media, PA (US)

(73) Assignee: Metal Systems Technologies, LLC, Media, PA (US)

( * ) Notice: Subject to any disclaimer, the term of this patent is extended or adjusted under 35 U.S.C. 154(b) by 0 days.

(21) Appl. No.: 14/681,192

(22) Filed: Apr. 8, 2015

(65) Prior Publication Data

US 2015/0314546 A1 Nov. 5, 2015

Related U.S. Application Data

(60) Provisional application No. 61/977,295, filed on Apr. 9, 2014.

(51) Int. Cl.
*B30B 1/10* (2006.01)
*B30B 15/00* (2006.01)

(52) U.S. Cl.
CPC ..... *B30B 1/106* (2013.01); *B30B 15/0052* (2013.01)

(58) Field of Classification Search
CPC ..... B30B 1/106; B30B 1/06; B30B 1/10; B30B 1/14; B30B 15/00; B30B 1/268; B30B 15/0052; B30B 1/183
See application file for complete search history.

(56) References Cited

U.S. PATENT DOCUMENTS

| | | | | | |
|---|---|---|---|---|---|
| 2,610,524 | A | * | 9/1952 | Maust | 74/603 |
| 3,495,472 | A | * | 2/1970 | Long | 74/570.3 |
| 3,766,771 | A | * | 10/1973 | Spachner et al. | 72/450 |
| 3,795,168 | A | * | 3/1974 | Spachner et al. | 83/617 |
| 3,817,139 | A | * | 6/1974 | Desai et al. | 83/617 |
| 5,916,345 | A | * | 6/1999 | Kobayashi | 83/543 |

* cited by examiner

*Primary Examiner* — Alexander P Taousakis
*Assistant Examiner* — Leonel Vasquez
(74) *Attorney, Agent, or Firm* — Antonio Papageorgiou, Esq.; Meister Seelig & Fein LLP

(57) ABSTRACT

The present application provides a four-bar press that includes a plurality of linkages and at least one element for maintaining at least one of the plurality of linkages in the four bar press in compression during at least a portion of a press cycle. This beneficially reduces undesirable characteristics of the press, such as jerk, which enables use of smaller and lighter components.

5 Claims, 16 Drawing Sheets

FOUR-BAR PRESS WITH INCREASED STROKE RATE AND REDUCED PRESS SIZE

RELATED APPLICATION

This application claims the benefit of U.S. (Provisional) Application No. 61/977,295, filed Apr. 9, 2014.

BACKGROUND OF THE INVENTION

The present application relates to industrial equipment and more particularly to mechanical/hydraulic presses.

Almost every existing machine and much equipment in everyday use, e.g. refrigerators, heating systems, automobiles, airplanes, office furniture, contains metal parts produced by mechanical or hydraulic presses. These presses stamp, draw, or extrude metal blanks or billets to produce the parts desired. Almost all mechanical presses utilize a slider-crank linkage to convert crank rotation to press slide displacement. FIG. 1 shows a schematic representation of such linkages. OA is the crank, AB is the slider.

Slider-crank presses have high stroke rates enabling production of stamped and shallow drawn parts at high rates per minute. These machines, however, generate their rated force over a short distance, only. As an example, a 1,000-ton press 20 ft high, possessing a 20 in total stroke, produces its rated force over only the last inch of its stroke. If the slide is loaded above one inch from bottom dead center (BDC), required crank torque and side load on slide gibbing and frame increases greatly. Slide load must be significantly reduced to avoid overloading the press drive and generation of high loads on slide bearings and gibs.

A 1,000-ton hydraulic press possessing the same total stroke and force rating as a mechanical press easily can exert its rated force over six inches enabling production of metal parts by deep drawing or extrusion in addition to executing stamping and shallow drawing operations. The accompanying disadvantages are low stroke rate, only a few parts can be produced per minute, low mechanical efficiency, greater complexity, and higher maintenance cost.

Referring to FIG. 2, a schematic representation of a press linkage is shown in which two links are added to the slider-crank linkage. Link 1 is the crank, link 2 is the drag link, link 3 is the lazy link, oscillating during crank rotation, and link 4 is the slider. This mechanism is termed a four-bar linkage. When the links are properly sized, rated press force is generated over a long stroke, similar to that of a hydraulic press, while maintaining a much higher stroke rate than can be attained by a hydraulic press. This capability makes it possible to replace several hydraulic presses with a single four bar press. A second advantage of four-bar press use is tooling shock reduction in stamping operations. The slide velocity of a four-bar stamping press as the slide enters its work stroke, operating at the same production rate as a slider-crank press, is much lower than that of slider-crank press, reducing kinetic energy at impact by over 80% with concomitant reduction in noise, improving the environmental quality of the workplace. Currently, the noise level in a room containing 20 35-ton slider-crank stamping presses prevents conversation. Ear protection is mandatory; information is transmitted by hand signals. The reduction in impact energy also enables use of high wear-resistant steel punches which have only nominal shock resistance in place of tough, relatively ductile tool steel punches which have lower tool life, markedly reducing tooling cost.

Presently, four bar presses have a stroke rate limitation resulting from sudden changes in slide acceleration or "jerk".

The slow movement of the slide over a relatively long work stroke must be compensated for by rapid slide return if the production rate achieved by a slider-crank press of similar tonnage is to be matched. This rapid change causes a rapid change in slide acceleration which, in turn, causes linkage pin-bearing contact areas to suddenly shift and generate "linkage slam". Linkage slam is directly proportional to the third power of crank rotation or stroke rate, and consequently suddenly occurs as stroke rate is increased. This cannot be tolerated since linkage bearing pound-out and failure will occur shortly thereafter if the stroke rate is not reduced.

Use of larger bearings and pins to reduce bearing stress and minimize pound-out enables attainment of higher stroke rates but substantially increases four-bar press cost because the increased size of the links requires use of a relatively large press crown and frame. Generally, it is preferable to use smaller links and limit stroke rate to a value at which linkage slam does not occur.

Four-bar linkages also generate a shaking force, developed by the skewed elliptical movement of the center of gravity of the drag link and the crank during a press stroke, limiting stroke rate. This force is reduced by link design minimizing element inertia enabling use of higher stroke rates.

Accordingly, there is a need for presses and other industrial equipment that are not limited as such.

SUMMARY OF THE INVENTION

The capability of four bar linkage use in mechanical presses to generate press rated force over a long work stroke with nominal crank torque and low slide side thrust is increased by holding the linkage in compression through the entire slide cycle. This is achieved by use of one or more gas actuated cylinders which operate under near-adiabatic conditions.

Maintenance of linkage compression through the press cycle greatly reduces or entirely eliminates jerk, enabling the use of higher linkage bearing and pin loads, which in turn reduces the size of the drag link and the lazy link. Reduction of the size of these links enables a reduction to be made in press bed and crown size. Reduction of the drag link size, and weight, enables a reduction in press shaking force.

Gross reduction of jerk also increases stroke rate at which linkage slam can occur, increasing the stroke rate capability of the four-bar press. Jerk, which causes linkage slam, may be virtually eliminated by holding the four-bar linkage in compression at all times. This allows the press to be operated at a higher stroke rate, achieving a higher production rate, without encountering linkage slam. A stroke rate limit still exists, however, because of "jolt". Jolt is the first time derivative of jerk and the fourth time derivative of slide displacement. The sudden rise and fall of compressive stress in a link held in compression generates a tension and rarefaction wave in the link which will cause linkage slam at very high stroke rates.

Two four-bar linkages and their performance are described in preferred embodiments, which are compact and have low shaking force. The linkages are held in compression through the press cycle by four air-actuated cylinders. Air is supplied by a rechargeable reservoir. One linkage is used for high speed stamping and shallow drawing operations requiring up to 30 tons force. The second linkage is used for deep drawing and front and back extrusion operations requiring up to 60 tons force.

The great reduction in jerk and reduced shaking force enables an increase in four bar press production rate of 30% while preserving all advantages of four-bar linkage use.

Additional aspects of the present invention will be apparent in view of the description which follows.

DETAILED DESCRIPTION OF THE INVENTION

Figure 1:
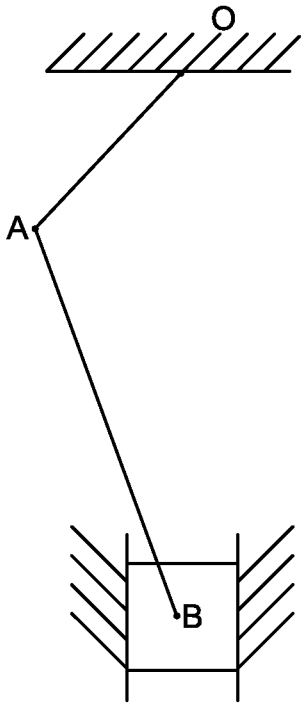
FIG. 1 (Prior Art)
FIG. 1 is a schematic Representation of Slider-Crank Press Linkage and Slide.
Figure 2:
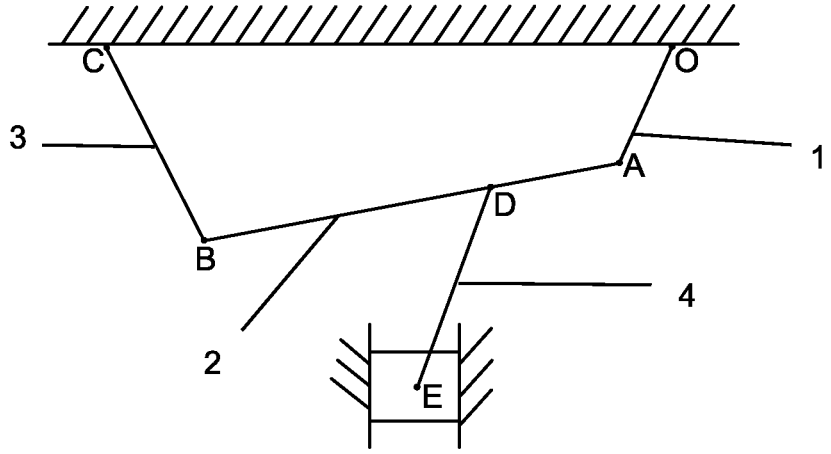
FIG. 2 is a representation of Four-Bar Press Linkage and Slide

A first objective of at least one embodiment of the invention is provision of a means of either reducing impact or pulse loading of four-bar linkage bearings by linkage pins at any crank rotation velocity to a negligible value or eliminating it entirely by preventing loss of contact between the pins and bearings when acceleration reversal manifests itself as jerk preventing impulse loading of bearings. Elimination of pin-bearing impulse loading enables use of the higher bearing stresses employed in slider-crank linkage design, substantially reducing the size and weight of the four-bar links, and size and weight of the press crown and frame.

A second objective of at least one embodiment of the invention is the reduction in shaking force caused by the drag link, enabling the four-bar press to operate at higher stroke rates. This is accomplished by use of a smaller and lighter weight drag link, made possible by the allowed use of higher pin-bearing stresses used in slider-crank linkage design.

A third objective of at least one embodiment of the invention is the reduction of shaking force generated by the asymmetrical crank.

The first two objectives may be accomplished by maintenance of a compressive load on all pins and bearings throughout the press cycle, which is sufficiently high to prevent loss of contact between the pins and bearings when acceleration rate change manifests itself as jerk. Pin-bearing contact location will shift during this time, loading a different bearing area without linkage slam.

Linkage force prior to tool-work piece contact and throughout the entire stroke is held in compression and is described by the equation:

$$F_{net}=+W_t\mp F_i\mp F_f-F_w-F_{cb}, \text{ where:}$$

$F_{net}$ is the sum of all forces acting on the slide and always is negative.

$W_t$ is the slide assembly weight, including the bolster plate and tooling connected to the slide.

$F_i$ is the slide inertia force.

$F_f$ is the slide friction force between the slide gibbs and ways.

$F_w$ is the work load during the work stroke, otherwise zero.

$F_{cb}$ is the counterbalancing force applied to the slide and linkage.

$W_t$, slide assembly weight, always exerts a tensile load on the linkage in a vertical press.

A plus sign denotes linkage tension; a minus sign denotes linkage compression. The $\mp$ notation indicates occurrence of tension/compression reversal in the linkage during the press stroke or a shift in the direction of the force on the press ways.

$F_i$, slide inertia force, alternates between tensile and compressive force during slide movement and is responsible for linkage load reversal prior to tool-work piece contact. $F_i$ is calculated by multiplying the slide mass in slugs (slide mass in lbs divided by 386.4 in/sec$^2$, the gravitational constant) by the slide acceleration in in/sec$^2$. $F_f$, slide friction force, may load either the right or left press ways, and changes direction in opposition to slide velocity. $F_{cb}$, counterbalancing force, in the preferred embodiments of this invention, holds all bearings and pins of the 4-bar linkage in compression throughout the press cycle.

One or more gas-actuated cylinders or any other means for exerting a force counterbalancing the slide inertial force which either reduces impulse loading of four-bar linkage pins and bearings to a negligible value through the press slide cycle or, in the preferred embodiment of the invention, eliminates such loading entirely by holding the linkage in compression throughout the cycle. In such instance, the gas-actuated cylinder(s) exert a force which is greater than the total weight of the slide and any accessories attached to the slide, such as a tool bolster plate and tooling.

The gas supply for the actuated cylinders may be contained in a tank whose volume is sufficiently large relative to gas cylinder volume to ensure that the desired linkage compressive loading is maintained on all 4-bar pins and bearings throughout the press slide stroke.

Gas cylinder(s), piping, and the air receiver, or tank, do not require thermal insulation to operate efficiently. If, however, the counterbalance system is thermally insulated to enable adiabatic gas compression and expansion, entropy is substantially reduced and the interval between tank recharging is increased.

If air is used as the gas in the counterbalance system, the system tank may be easily recharged using the compressed air supply present in most press user's plants to operate part transfer tooling.

A third objective is according to at least one embodiment of the invention is accomplished by use of crank counterweights on the bull gears when two bull gears are employed to drive the four-bar linkage crank and linkage dimensions proscribe use of counterweights on crank cheeks.

PREFERRED EMBODIMENTS

Two preferred embodiments of this invention are described. The first is a 30-ton 4-bar press with a 0.25 in workstroke operating at 120 strokes per minute. This press performs blanking and shallow drawing operations. The second preferred embodiment is a 60-ton 4-bar press with a 2.5 in workstroke operating at 60 strokes per minute. This press is utilized for deep drawing, forward, and back extrusion operations normally executed by hydraulic presses operating at much slower stroke rates. Linkages of both presses are held in compression through the slide cycle.

30 Ton 4-Bar Press Specifications

| General Specifications | |
|---|---|
| Total stroke | 2.84 in. |
| Workstroke | 0.25 in. |
| Stroke rate | 120 strokes per minute |
| Bed size | 15 in left-to-right |
| | 18 in front-to-back |
| Slide, bolster plate and tooling weight | 1100 lb |

| Counterbalance System Specifications | |
|---|---|
| Max. Counterbalance force | 2925 lbs. |
| Number of counterbalance cylinders | 2 |
| Cylinder bore | 6.00 in. |
| Cylinder stroke | 2.84 in. |
| Max. counterbalance pressure | 2925/(2*0.25* π *36.00) ≈ 52 psig |
| Air receiver volume | 30 gal |
| Air Receiver charge pressure | $P_a$ = 52 psig |

Air pressure at slide top dead center (TDC) is approximately 52 psig.

Air volume $V_a$ at (TDC) using a 30 gal capacity air receiver is approximately 30*231 = 6930 $in^3$ Air volume $V_b$ at slide bottom dead center (BDC) is approximately 6930 + 0.25*π*36.00*2*2.84 = 7091 $in^3$ The air delivery system is thermally insulated to establish near-adiabatic compression and expansion conditions. The following calculation assumes adiabatic conditions and neglects volume of piping and control valves.

$P_aV_a^{1.4}=P_bV_b^{1.4}$. where:

$P_a$ is the air pressure at the beginning of the air cylinders stroke $V_a$ is the volume of the air receiver $P_b$ is the air pressure at the end of the air cylinders stroke $V_b$ is the volume of the air receiver and the gas volume of the two air cylinders at the end of the air cylinders stroke Air pressure $P_b$ at slide bottom dead center (BDC) is $P_aV_a^{1.4}/V^{1.4}=52*6930^{1/4}/\ 7091^{1.4}=50.4$ psig or approximately 50 psig.

Compressive stress variation on linkage pins and bearings is less than 4% through the idle stroke of the press.

Linkage Layout, Link Weights, Dimensions, Pin and Bearing Size, Load Data

Figure 3:
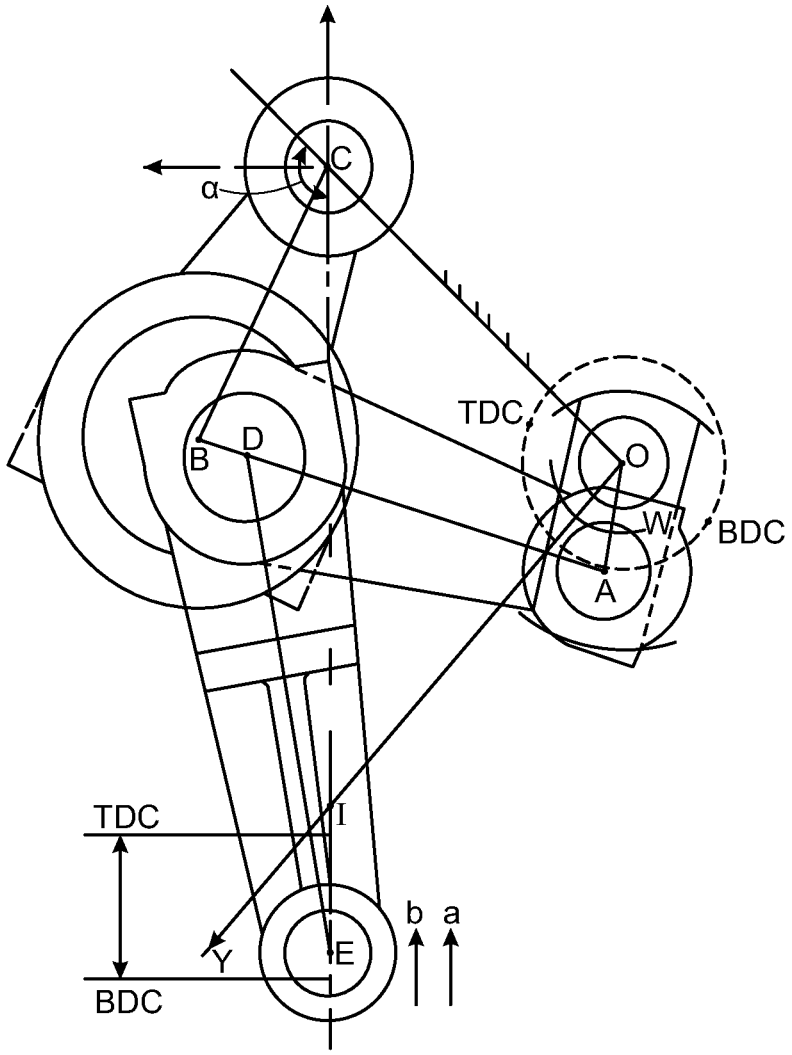
FIG. 3 is a representation of a 30-ton Four-Bar Linkage, Side View
Figure 4:
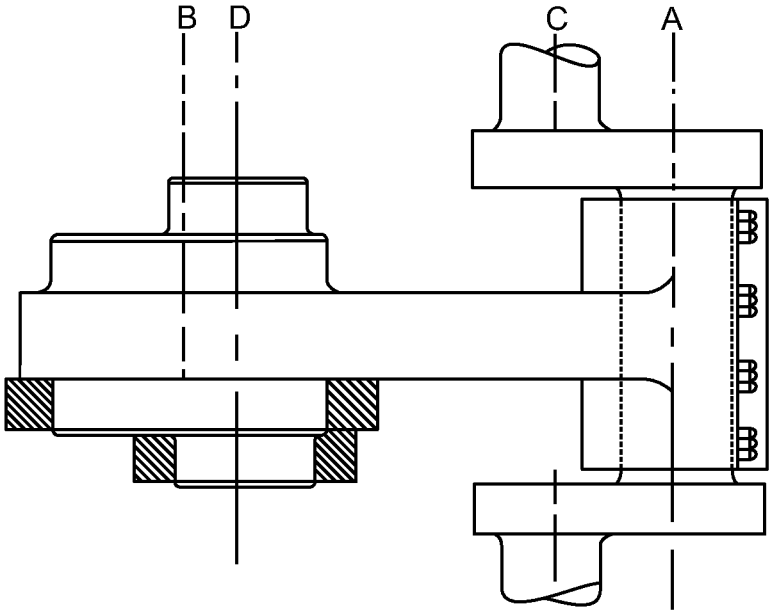
FIG. 4 is a representation of a 30-ton Four-Bar Linkage, Front View

FIG. 3 shows a side view of the linkage and FIG. 4 shows a front view of the linkage according to one embodiment of the invention. Distances between pin or crank centers, pin diameters, and bearing stresses are shown in Table 1.

TABLE 1

| 30-TON 4-BAR LINKAGE SPECIFICATIONS | | | | | |
|---|---|---|---|---|---|
| Distance between Pin or Crank Centers, in | | Pin Diameters, in | | Bearing Stress, $lb/in^2$ | |
| OA | 2.20 | A | 2.50 | A | 1000 |
| AB | 8.80 | B | 5.00 | B | 5600 |

TABLE 1-continued

| 30-TON 4-BAR LINKAGE SPECIFICATIONS | | | | | |
|---|---|---|---|---|---|
| Distance between Pin or Crank Centers, in | | Pin Diameters, in | | Bearing Stress, $lb/in^2$ | |
| BC | 6.22 | C | 1.75 | C | 13300 |
| CO | 8.42 | D | 2.50 | D | 13300 |
| AD | 7.83 | E | 1.80 | E | 13300 |
| DE | 10.12 | O | 1.80 | O | 1543 |
| OI | 9.01 | | | | |

60-Ton 4-Bar Press Specifications

| General Specifications | |
|---|---|
| Total stroke | 9.00 in. |
| Workstroke | 2.50 in. |
| Stroke rate | 60 strokes per minute |
| Bed size | 20 in left-to-right |
| | 20 in front-to-back |
| Slide, bolster plate and tooling weight | 3350 lb |

| Counterbalance System Specifications | |
|---|---|
| Max. Counterbalance force | 7200 lb. |
| Number of counterbalance cylinders | 4 |
| Cylinder bore | 6 in. |
| Cylinder stroke | 9 in. |
| Max. Counterbalance Pressure | 7200/(4*0.25* π *36) = 64 psig |
| Air receiver volume | 60 gal |
| Air Receiver charge pressure | Pa = 64 psig |

Air pressure at slide top dead center (TDC) is approximately 52 psig.

Air volume $V_a$ at (TDC) using a 60 gal capacity air receiver is approximately 60*231 = 13860 $in^3$ Air volume $V_b$ at slide bottom dead center (BDC) is approximately 13860 + 0.25*π*36*4*9.00 = 14878 $in^3$ The air delivery system is thermally insulated to establish near-adiabatic compression and expansion conditions. The following calculation assumes adiabatic conditions and neglects volume of piping and control valves. Therefore, $P_aV_a^{1.4}=P_bV_b^{1.4}$.

Air pressure $P_a$ at slide bottom dead center (BDC) is $P_b=(P_aV_a^{1.4})/V_b^{1.4}=(64*13860^{1.4})/14878^{1.4}=58.0$ psig. Compressive stress variation on linkage pins and bearings is approximately 10% through the idle stroke of the press.

Linkage Layout, Link Weights, Dimensions, Pin and Bearing Size, Load Data

Figure 9:
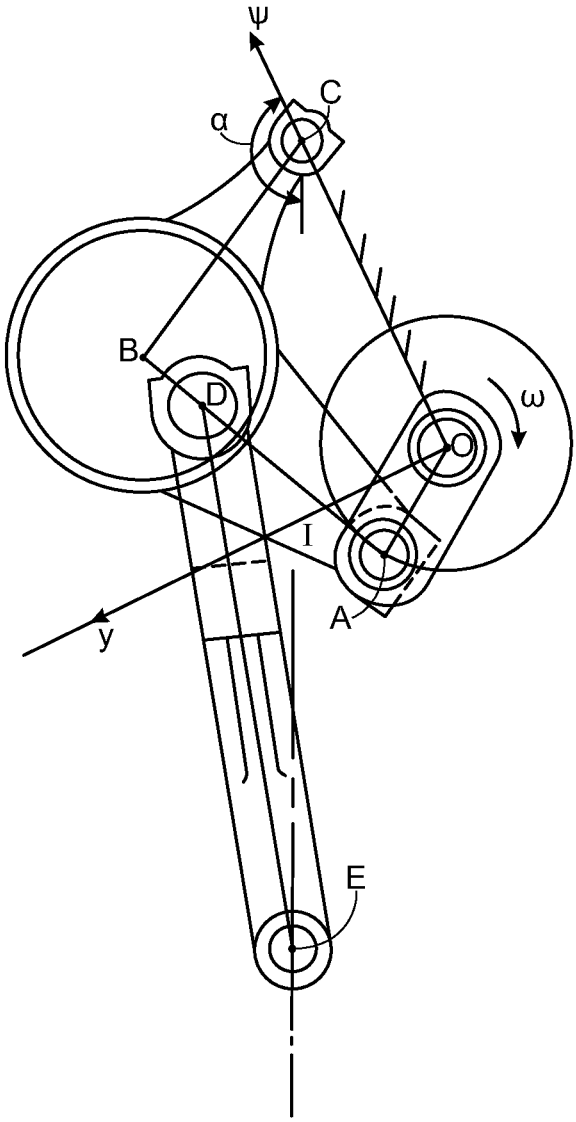
FIG. 9 is a representation of a 60-ton Four-Bar Linkage, Side View
Figure 10:
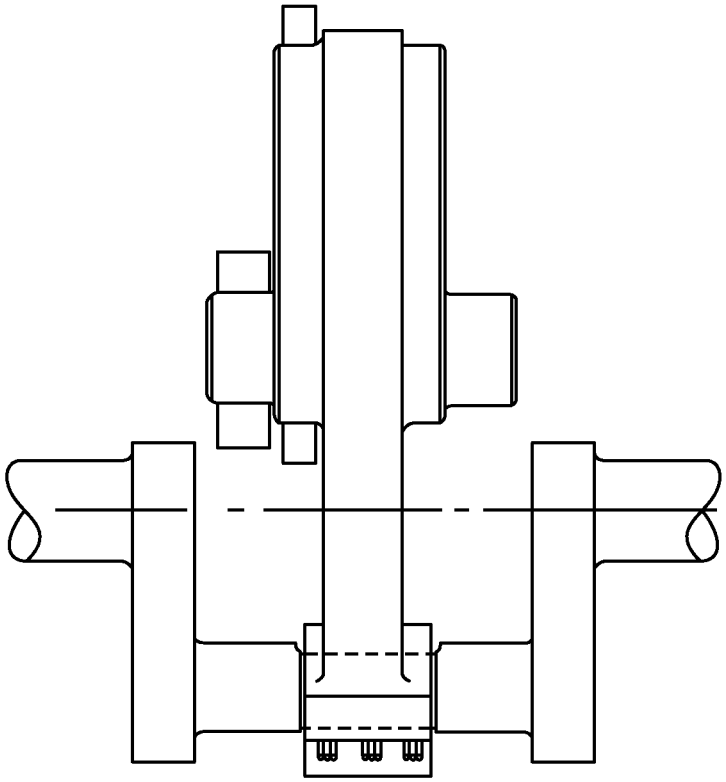
FIG. 10 is a representation of a 60-ton Four-Bar Linkage, Front View

FIG. 9 shows a side view of the linkage and FIG. 10 shows a plan view of the linkage according to another embodiment of the invention. Distances between pin or crank centers, pin diameters, and bearing stress are shown in Table 2.

TABLE 2

| 60-TON 4-BAR LINKAGE SPECIFICATIONS | | | | | |
|---|---|---|---|---|---|
| Distance between Pin or Crank Centers, in | | Pin Diameters, in | | Bearing Stress, $lb/in^2$ | |
| OA | 6.16 | A | 3.50 | A | 2500 |
| AB | 15.41 | B | 12.25 | B | 2019 |
| BC | 12.94 | C | 2.50 | C | 13000 |
| CO | 16.48 | D | 3.50 | D | 13300 |
| AD | 11.55 | E | 3.00 | E | 13300 |
| DE | 27.12 | O | 4.00 | O | 1375 |

Figure 5:
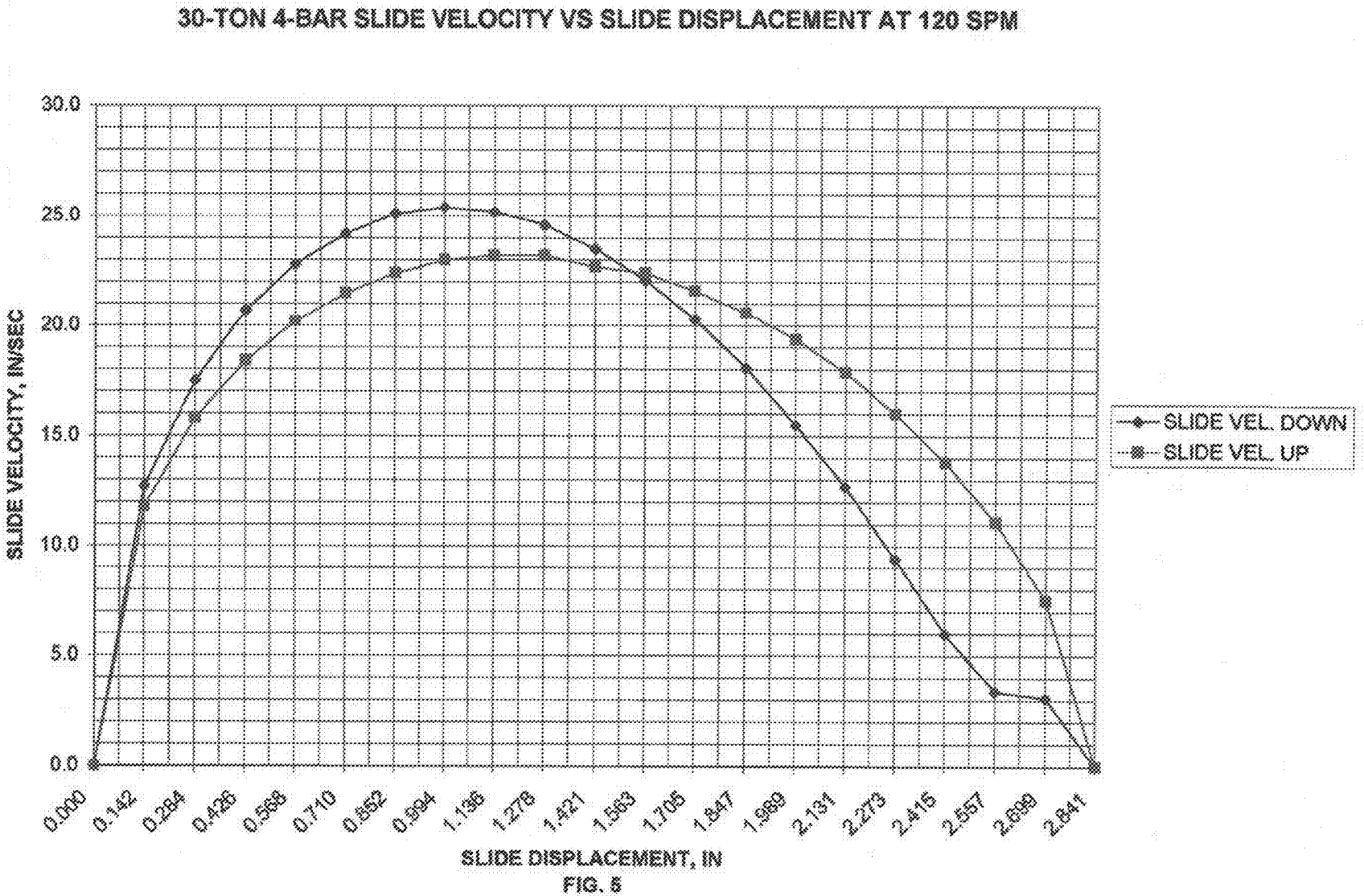
FIG. 5 is a plot of Slide Velocity vs Slide Displacement at 120 spm for a 30-ton Four-Bar Press
Figure 6:
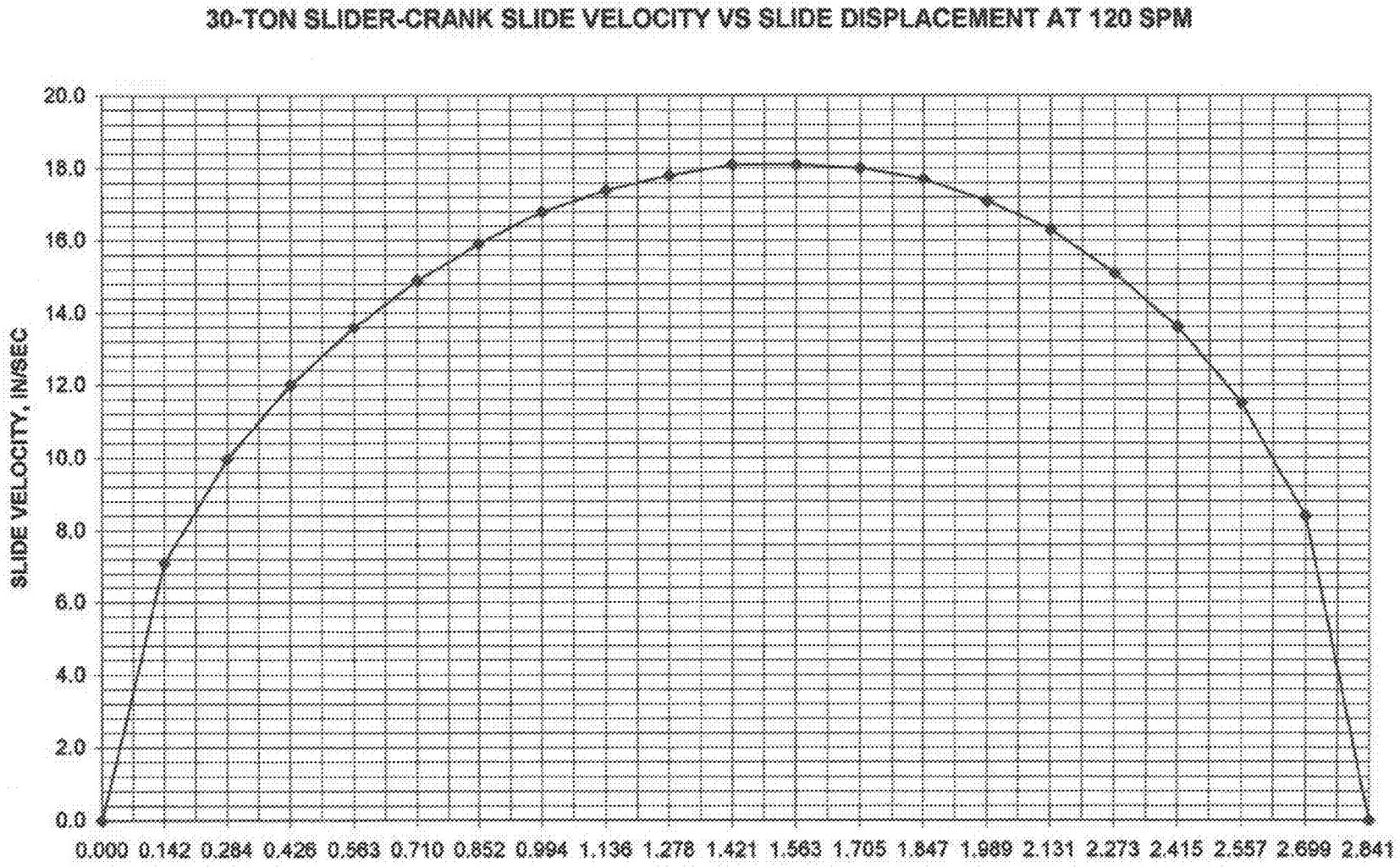
FIG. 6 is a plot of Slide Velocity vs Slide Displacement at 120 spm for a 30-ton Slider-Crank Press

Comparison of 30-Ton 4-Bar and 30-Ton Slider-Crank Press Kinematic and Dynamic Properties Kinematic Properties Referring to FIGS. 5 and 6, slide velocity is shown as a function of slide displacement through the 0.25 in workstroke for the 30-ton 4-bar press described and a slider crank press possessing the same force capability, stroke, workstroke and stroke rate.

Tabular data used to generate these charts shows that the 4-bar press slide velocity at the start of the one-quarter inch workstroke is 3.4 in/sec. Slider-crank press slide velocity at the same point is 10.0 in/sec. Press slide kinetic energy varies directly as the square of slide velocity. Hence, reduction in kinetic energy as the tooling attached to the 4-bar press slide contacts the workpiece one-quarter inch from bottom dead center is $[10.0^2-3.4^2]/*100/10.0=88\%$. Tool shock and noise on impact is greatly reduced. Further, the slower slide speed of the 30-ton 4-bar press through the workstroke enables it to blank thicker carbon steel strip than a 30-ton slider-crank press and have superior drawing and extrusion capability. Low-carbon or low-alloy steels are the most common meals stamped and formed by presses. These metals are strain rate sensitive. Decreasing the deformation rate decreases their shear strength and flow stress, decreasing the amount of force required to effect shearing or plastic flow.

Dynamic Properties

Figure 7:
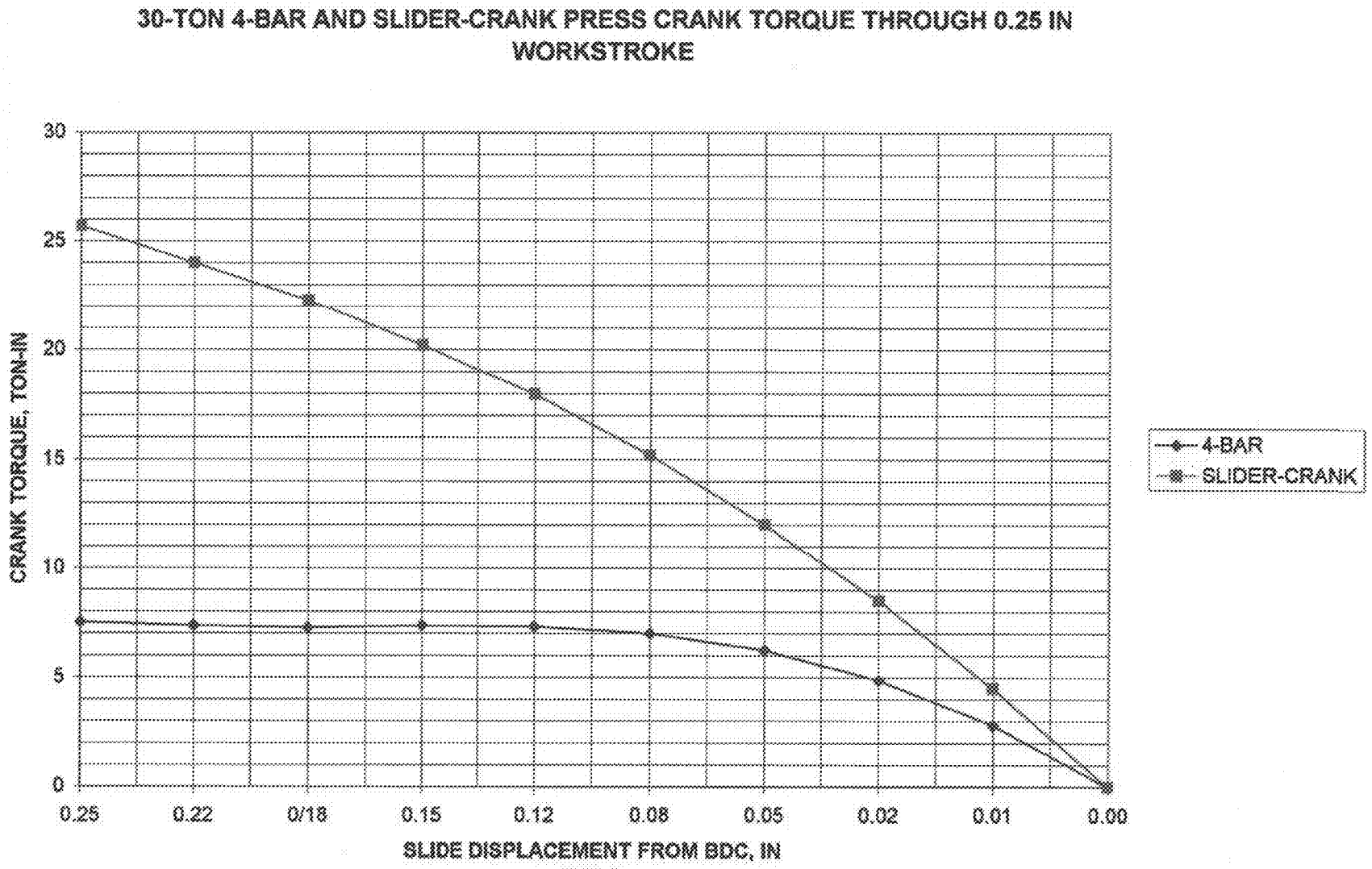
FIG. 7 is a plot of Crank Torque through 0.25 in Workstroke for a 30-ton Four-Bar Press and Slider-Crank Press, which shows that the crank torque required for a quarter-inch workstroke is much less in the four-bar press described than in a slider-crank press, enabling use of smaller drive gears and a more compact press crown.

FIG. 7 shows a comparison of the crank torque required through the 0.25 in workstroke of a 30-ton 4-bar and a slider-crank press possessing the same 2.84 in stroke. Peak torque requirement of the slider-crank press when the slide is 0.25 in from bottom dead center is 3.3 times greater than that of the 4-bar press.

Figure 8:
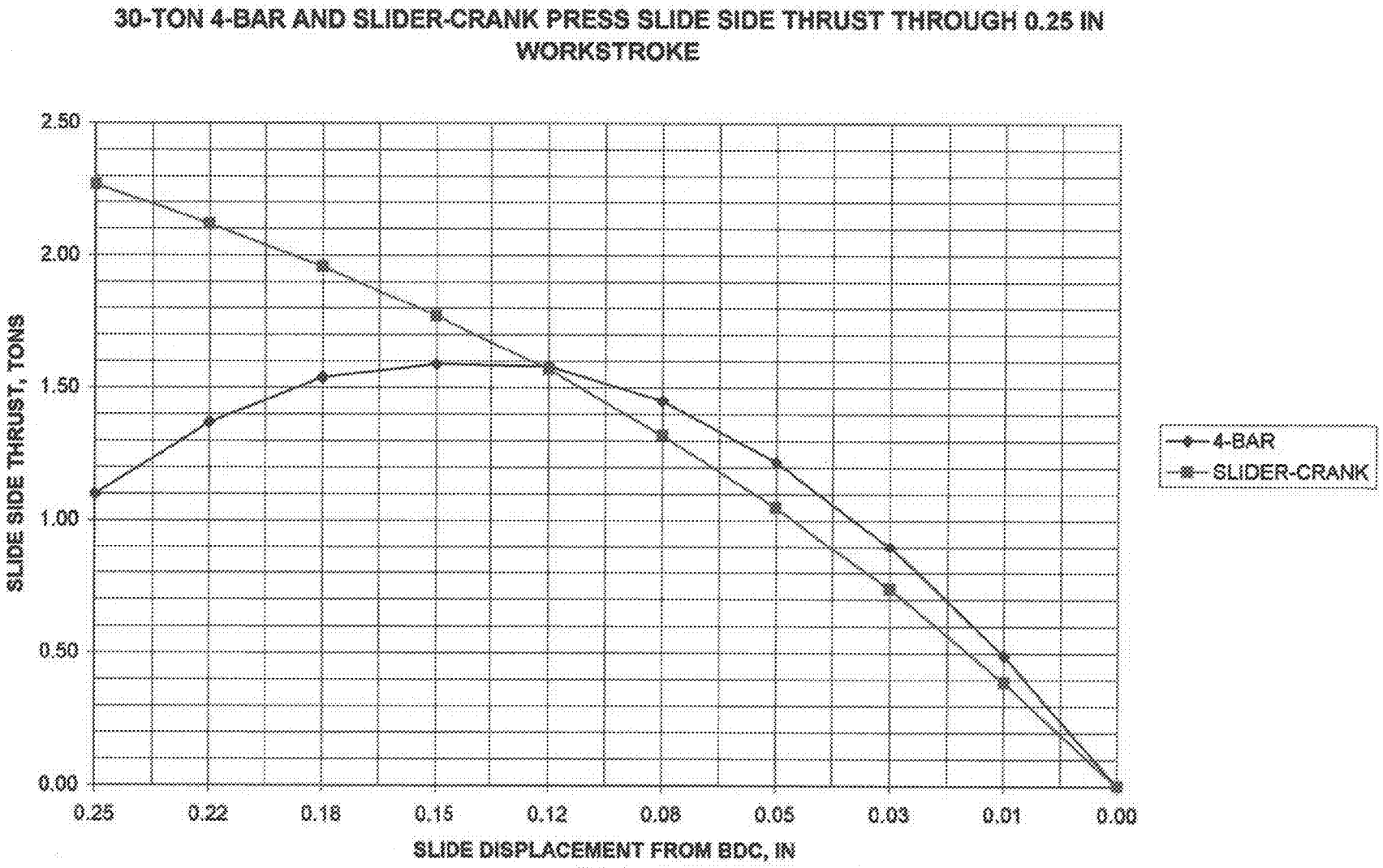
FIG. 8 is a plot of Slide Side Thrust through 0.25 in Workstroke for a 30-ton Four-Bar Press and Slider-Crank Press

FIG. 8 shows a comparison of the force exerted by the press slide on the gibbing (side thrust) by the 30-ton 4-bar and slider-crank presses through the 0.25 in workstroke. Maximum slider-crank side thrust is 2.1 times greater than that of the 4-bar press.

Figure 11:
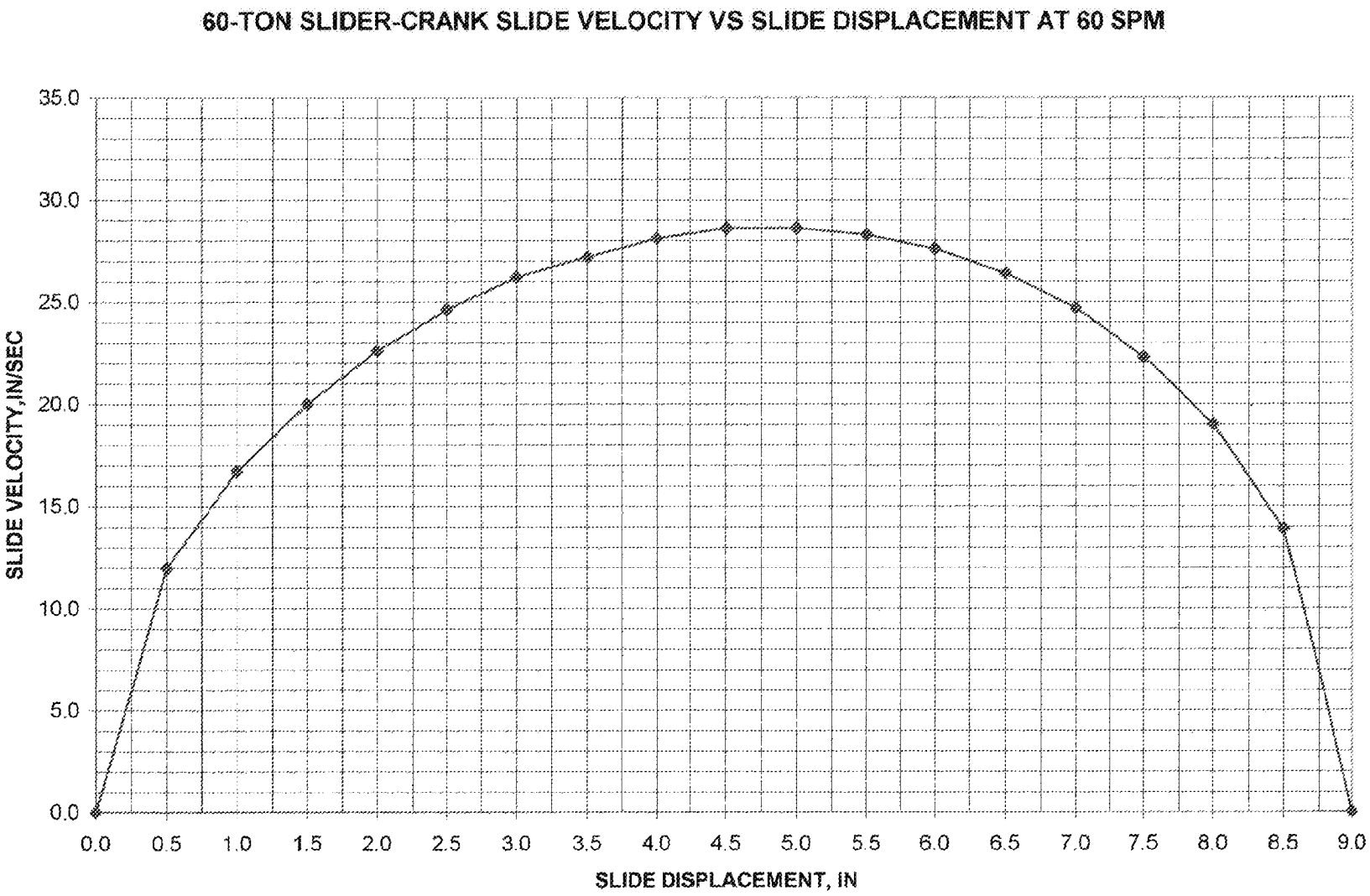
FIG. 11 is a plot of Slide Velocity vs. Slide Displacement at 60 spm for a 60-ton Slider Crank Press
Figure 12:
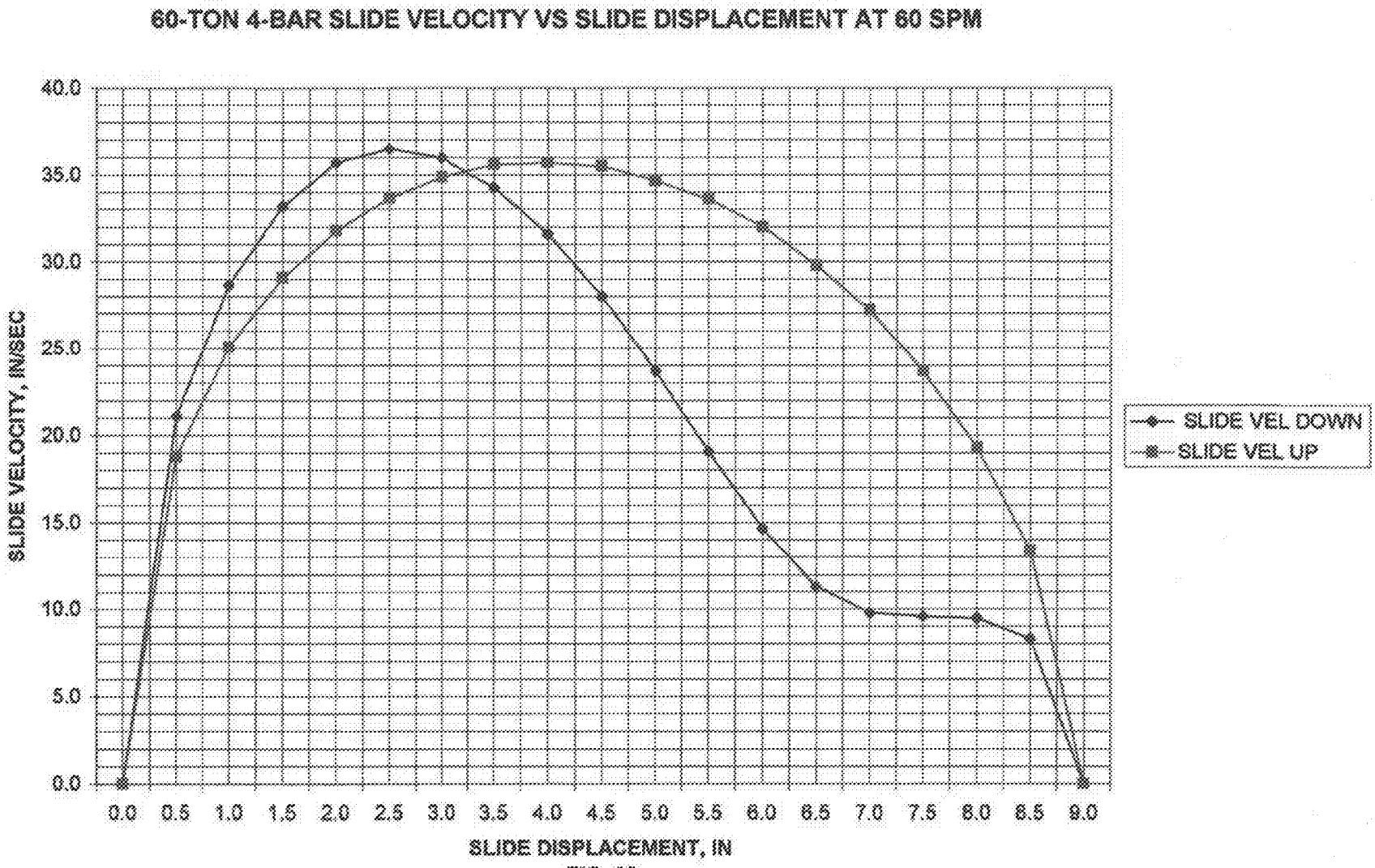
FIG. 12 is a plot of Slide Velocity vs. Slide Displacement at 60 spm for a 60-ton Four Bar Press

Comparison of 60-Ton 4-Bar and 60-Ton Slider-Crank Press Kinematic and Dynamic Properties Kinematic Properties FIGS. 11 and 12 show the slide velocity as a function of slide displacement through the 2.50 in workstroke for the 60-ton 4-bar press described and a slider crank press possessing the same force capability, stroke, workstroke and stroke rate. Tabular data used to generate these charts shows that the 4-bar press slide velocity at the start of the two-and-a-half inch workstroke is 11.3 in/sec. Slider-crank press slide velocity at the same point is 26.4 in/sec. Press slide kinetic energy varies directly as the square of slide velocity. Hence, reduction in kinetic energy as the tooling attached to the 4-bar press slide contacts the workpiece two-and-a-half inches from bottom dead center is$[26.4^2-11.3^2]*100/26.4^2=82\%$. Tool shock and noise on impact is greatly reduced. Further, the slower slide speed of the 60-ton 4-bar press through the workstroke enables it to have superior drawing and extrusion capability when forming low-carbon or low-alloy steels since these metals are strain rate sensitive.

Dynamic Properties

Figure 13:
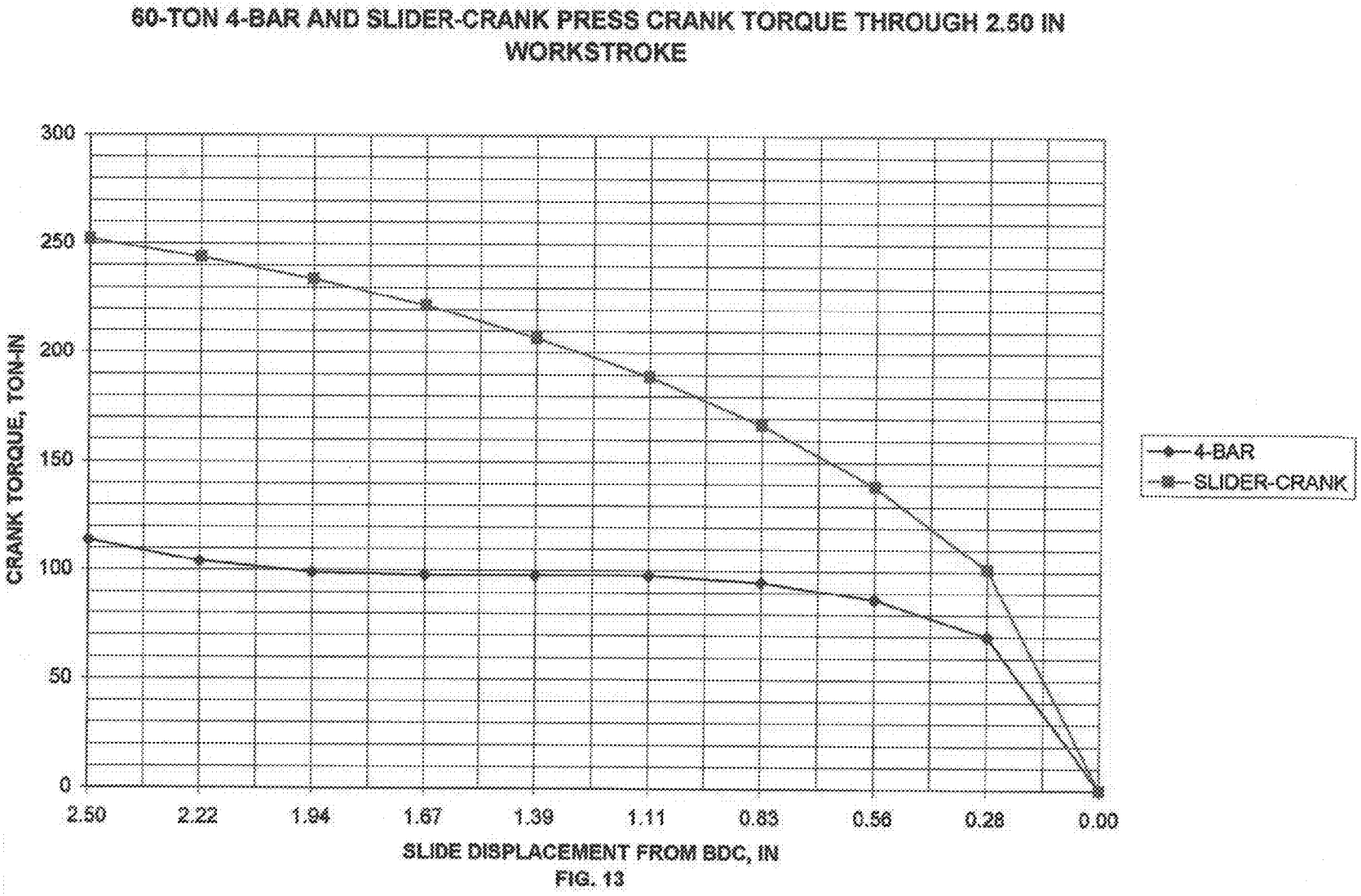
FIG. 13 is a plot of Crank Torque through 2.50 in Workstroke for a 60-ton Four-Bar Press and Slider-Crank Press

FIG. 13 shows a comparison of the crank torque required through the 2.50 in workstroke of a 60-ton 4-bar and a slider-crank press possessing the same 9.00 in stroke. Peak torque requirement of the slider-crank press when the slide is 2.50 in from bottom dead center is 2.21 times greater than that of the 4-bar press.

Figure 14:
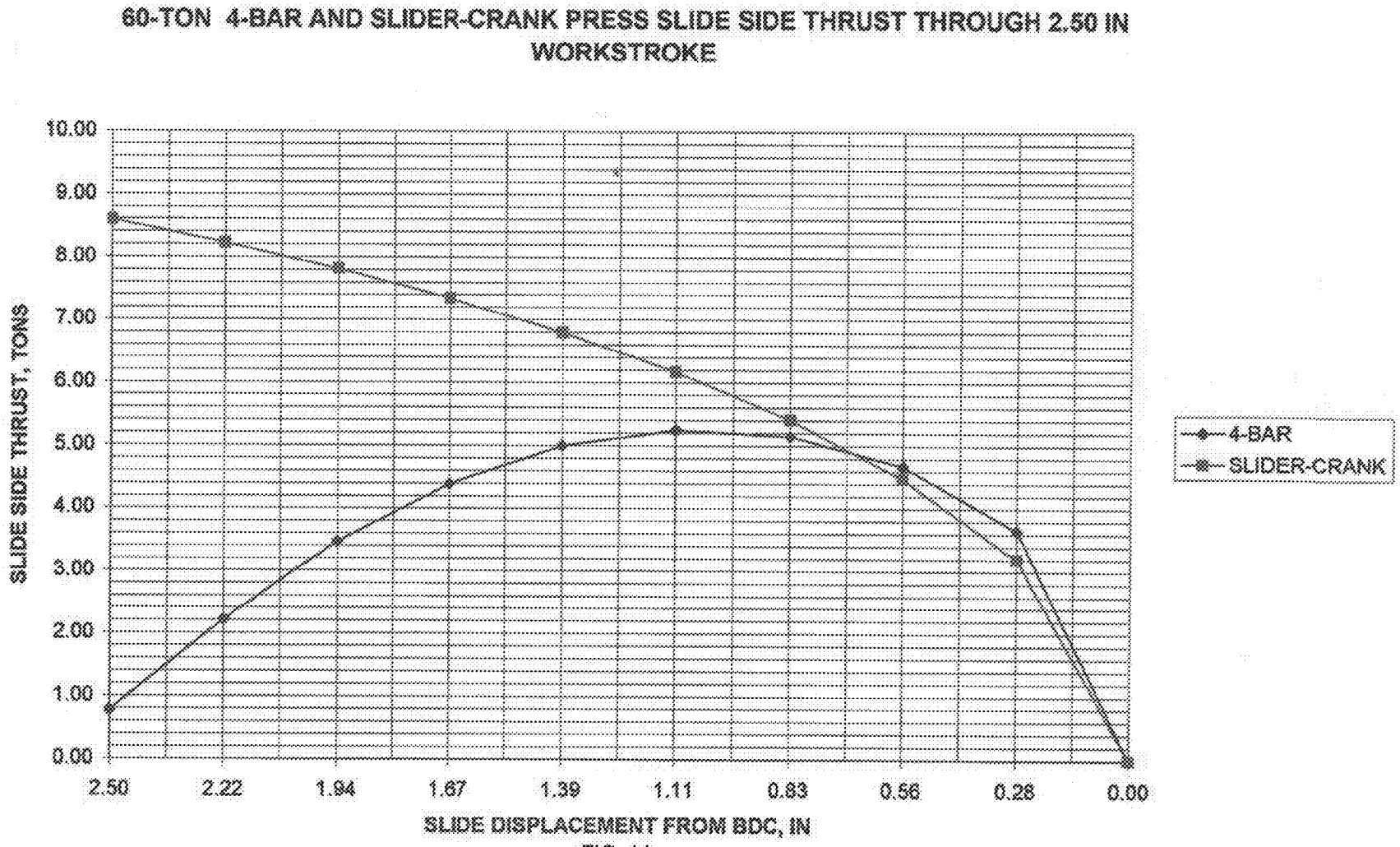
FIG. 14 is a plot of Slide Side Thrust through 2.50 in Workstroke for a 60-ton Four-Bar Press and Slider-Crank Press

FIG. 14 shows a comparison of the force exerted by the press slide on the gibbing (side thrust) by the 60-ton 4-bar and slider-crank presses through the 2.50 in workstroke. Maximum slider-crank side thrust is 1.64 times greater than that of the 4-bar press.

Figure 15A:
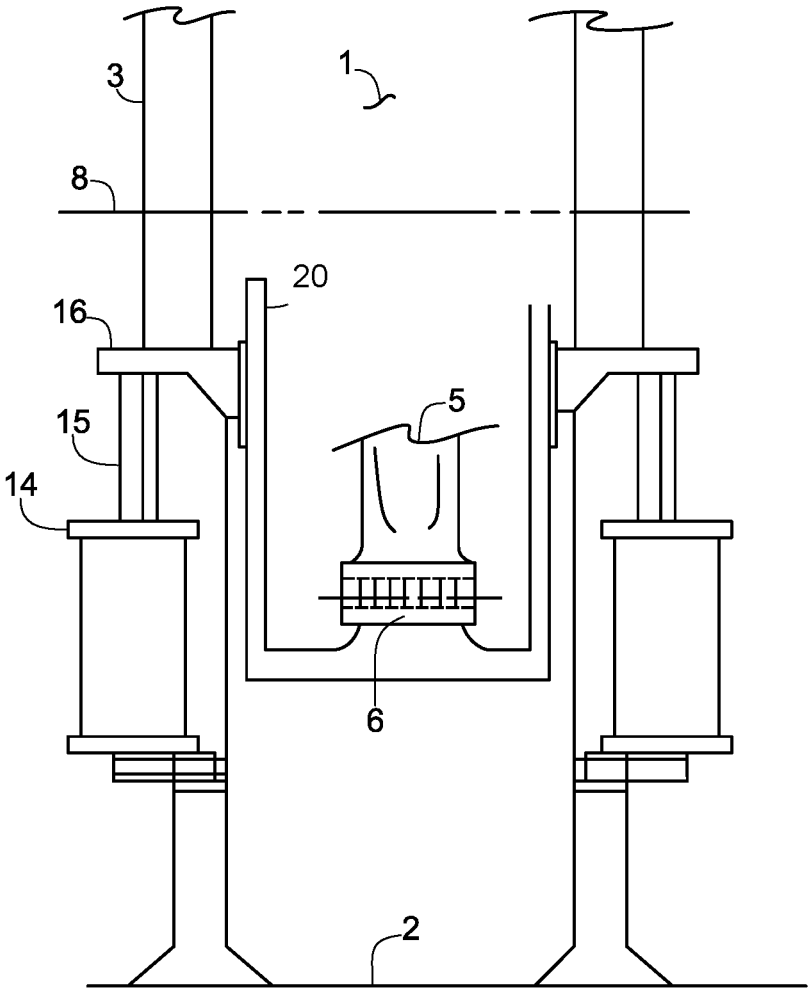
FIG. 15*a*-b are a representation of a four bar press according to at least one embodiment of the invention.
Figure 15B:
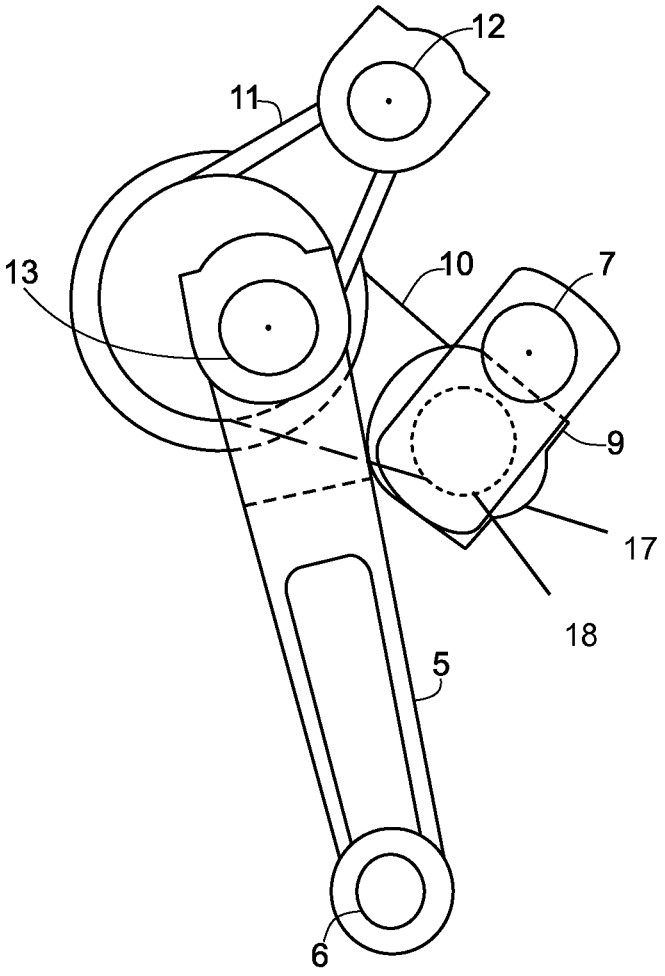

FIGS. 15*a* and 15*b* show a four bar press with the following components: Press Crown Area 1, Press Bed 2, Frame 3, Slide 20, Connection Link 5, Connection Pin 6, Crank Journal Pin 7, Crank Axis Centerline 8, Crankshaft 9, Drag Link 10, Lazy Link 11, Lazy Link Crown Pin 12, Connection Upper Pin 13, Counterbalance Cylinder 14, Piston Rod 15, Piston Rod Attachment to Slide 16, crank counterweight 17 and the press bull gear 18. As can be seen, the counterbalance cylinders 14 are connected to the slide 4 via attachment 16. In this regard, the cylinders 14 may expand, thereby placing the compression on the connecting link 5 via connecting pin 6 as desired. The present invention is described in the forgoing Examples, which are set forth to aid in the understanding of the invention, and should not be construed to limit in any way the scope of the invention as defined in the claims which follow thereafter.

While the foregoing invention has been described in some detail for purposes of clarity and understanding, it will be appreciated by one skilled in the art, from a reading of the disclosure, that various changes in form and detail can be made without departing from the true scope of the invention.

What is claimed is:

1. A four-bar press comprising:

a crank link;

a drag link;

a lazy link;

a slider link, the crank link pivotally connected to the drag link via a first pin, and the drag link pivotally connected to the lazy link via a second pin and to the slider link via a third pin, the third pin located on the drag link between the first and second pins; and one or more actuators pivotally coupled indirectly to the slider link via a fourth pin, wherein the one or more actuators exert a force on the slider link that counterbalances inertial force that would otherwise result in the slider link being in tension during at least a portion of a press cycle, the force applied thereby maintaining the slider link in compression during the at least a portion of the press cycle.

2. The press of claim 1, wherein the one or more actuators maintains the slider link in compression during an entire press cycle.

3. The press of claim 1, wherein the one or more actuators exert a force that essentially eliminates impulse loading at at least one of the pins through the at least a portion of the press cycle.

4. The press of claim 1, wherein the one or more actuators exert a force on the slider link which is greater than a total weight of the slider link and any accessories attached to the slider link.

5. The press of claim 1, wherein the one or more actuators exert a force on the slider link to maintain a plurality of the links in compression during the at least a portion of the press cycle.

* * * * *